US011933051B2

(12) United States Patent
Nash et al.

(10) Patent No.: US 11,933,051 B2
(45) Date of Patent: Mar. 19, 2024

(54) ROLLED ROOF STANDING SEAM SYSTEM AND METHOD OF CONSTRUCTION

(71) Applicant: CertainTeed LLC, Malvern, PA (US)

(72) Inventors: Alex C. Nash, Downington, PA (US); William Lentlie, Worcester, MA (US); Paul A. Benensky, Collegeville, PA (US); Kim Dupont-Madinier, Somerville, MA (US)

(73) Assignee: CERTAINTEED LLC, Malvern, PA (US)

( * ) Notice: Subject to any disclaimer, the term of this patent is extended or adjusted under 35 U.S.C. 154(b) by 39 days.

(21) Appl. No.: 17/555,853

(22) Filed: Dec. 20, 2021

(65) Prior Publication Data

US 2022/0195733 A1 Jun. 23, 2022

Related U.S. Application Data

(60) Provisional application No. 63/127,814, filed on Dec. 18, 2020.

(51) Int. Cl.

| | |
|---|---|
| ***E04D 11/02*** | (2006.01) |
| ***E04D 5/14*** | (2006.01) |
| ***E04D 12/00*** | (2006.01) |

(52) U.S. Cl.

CPC ..... *E04D 11/02* (2013.01); *E04D 5/142* (2013.01); *E04D 5/143* (2013.01); *E04D 5/146* (2013.01); *E04D 12/002* (2013.01); *E04D 12/004* (2013.01)

(58) Field of Classification Search

CPC ..... E04D 5/142; E04D 5/143; E04D 5/146; E04D 11/02; E04D 12/002; E04D 12/004; E04D 13/155

USPC .... 52/409, 411, 412, 462, 466, 506.05, 520, 52/540, 543

See application file for complete search history.

(56) References Cited

U.S. PATENT DOCUMENTS

| | | | | | |
|---|---|---|---|---|---|
| 993,686 | A * | 5/1911 | Howard | E04F 13/04 | 52/417 |
| 3,984,958 | A * | 10/1976 | Murray | E04D 3/366 | 52/468 |
| 4,443,993 | A * | 4/1984 | Fujiki | E04D 11/02 | 52/309.4 |
| 4,718,211 | A * | 1/1988 | Russell | E04D 5/142 | 52/409 |
| 4,833,853 | A * | 5/1989 | Deibele | E04D 13/1415 | 52/410 |
| 4,855,172 | A * | 8/1989 | Chiu | C09J 123/22 | 428/521 |

(Continued)

*Primary Examiner* — James M Ference

(74) *Attorney, Agent, or Firm* — Abel Schillinger, LLP; Stephen Eland

(57) ABSTRACT

The present disclosure relates generally to roofing structures, for example, suitable for covering houses and other structures. The present disclosure relates more particularly to a roofing structure including a decking layer, a base layer, a cap layer, and a plurality of rails disposed over the cap layer. The base layer includes a plurality of strips that form seams including a first base layer seam. The cap layer also includes a plurality of strips that form seams including a first cap layer seam that is spaced from the first base layer seam. The rails include a first rail that is aligned with the first base layer seam and a second rail that is aligned with the first cap layer seam.

20 Claims, 6 Drawing Sheets

(56) References Cited

U.S. PATENT DOCUMENTS 4,885,887 A * 12/1989 Simmons ..... E04D 5/147 52/459
5,168,684 A * 12/1992 Bruhm ..... E04D 5/146 52/410
5,319,908 A * 6/1994 Van Erden ..... E04D 3/3603 428/463
5,349,804 A * 9/1994 Van Erden ..... E04D 5/146 264/156
5,572,843 A * 11/1996 Jordan ..... E04D 5/146 52/410
6,004,645 A * 12/1999 Hubbard ..... B32B 7/12 52/409
6,006,482 A * 12/1999 Kelly ..... E04D 13/17 52/409
6,230,461 B1 * 5/2001 Piront ..... E04D 5/147 52/411
7,685,785 B2 * 3/2010 Johnson ..... E04D 12/002 52/409
7,861,478 B2 * 1/2011 Kalkanoglu ..... E04D 5/12 52/410
8,015,770 B2 9/2011 Kalkanoglu
8,230,656 B2 * 7/2012 Kalkanoglu ..... B32B 5/022 52/309.1
8,322,101 B2 * 12/2012 Kelly ..... E04D 5/142 52/412
8,322,113 B2 * 12/2012 Shapiro ..... E04D 5/146 52/410
8,590,245 B2 11/2013 Peng
8,608,884 B2 12/2013 Stanley
8,646,228 B2 * 2/2014 Jenkins ..... H02S 20/00 52/173.3
9,103,122 B2 * 8/2015 Boss ..... E04D 5/06
9,170,034 B2 10/2015 Bosler
9,896,846 B2 2/2018 Horton
2003/0070391 A1 * 4/2003 Tachauer ..... E04D 5/147 52/506.05
2006/0005496 A1 * 1/2006 Pressutti ..... E04D 5/10 52/518
2009/0107073 A1 4/2009 Kalkanoglu
2010/0192497 A1 * 8/2010 Kelly ..... E04D 5/142 52/409
2010/0307805 A1 12/2010 Resso
2011/0000158 A1 1/2011 Kalkanoglu
2011/0016811 A1 1/2011 Kalkanoglu
2013/0118545 A1 5/2013 Bosler
2015/0027069 A1 1/2015 Bosler
2016/0289969 A1 10/2016 Shiao
2016/0376789 A1 * 12/2016 Shevlin ..... F24F 13/32 52/698
2022/0195733 A1 * 6/2022 Nash ..... E04D 12/002

* cited by examiner

ROLLED ROOF STANDING SEAM SYSTEM AND METHOD OF CONSTRUCTION

CROSS REFERENCE TO RELATED APPLICATIONS

This application claims the benefit of priority of U.S. Provisional Patent Application No. 63/127,814, filed Dec. 18, 2020, which is hereby incorporated by reference in its entirety.

BACKGROUND OF THE DISCLOSURE

1. Field of the Disclosure

The present disclosure relates generally to roofing structures, for example, suitable for covering houses and other buildings. The present disclosure relates more particularly to a roofing structure including a plurality of layers and rails disposed over the layers.

2. Technical Background

Roofing systems typically include a roofing frame that forms the overall shape of the roof and a structure that forms the surface of the roof and is supported by the frame. The surface structure frequently includes a decking or sheathing that is covered by one or more weather resistant layers. For example, roofs are often covered with shingles that shed water and protect the roof from weather. Properly installed quality shingles will last a long time and can provide excellent protection for the roof. However, each shingle is typically installed individually, and the process of installing an entire roof with shingles is time consuming and costly.

Another roofing option is a standing seam roof. A traditional standing seam roof includes metal panels that are connected along enclosed seams, which forms an entirely closed roof surface. This type of roof is also effective and has a clean desirable aesthetic, but installation of standing seem roofs is complicated and can also be costly.

Accordingly, the present inventors have recognized that an alternative roofing structure with a desirable aesthetic that can be installed quickly and easily would be attractive to both builders and customers.

SUMMARY OF THE DISCLOSURE

In one aspect, the present disclosure provides a roofing structure that forms a roof surface, the roofing structure comprising:

- a decking layer providing a structural support for the roofing structure;
- a base layer disposed over the decking layer, the base layer including a plurality of strips including a first base layer strip adjacent to a second base layer strip so as to form a first base layer seam between the first base layer strip and the second base layer strip;
- a cap layer disposed over the base layer, the cap layer including a plurality of strips including a first cap layer strip adjacent to a second cap layer strip so as to form a first cap layer seam between the first cap layer strip and the second cap layer strip, wherein the first cap layer seam is spaced from the first base layer seam along the surface of the roofing structure; and
- a plurality of rails disposed over the cap layer and spaced apart across the surface of the roofing structure, the plurality of rails including a first rail aligned with the first base layer seam and a second rail aligned with the first cap layer seam.

In another aspect, the disclosure provides a roofing panel including the roofing structure of the disclosure, wherein the decking layer defines a first lateral edge of the roofing panel.

In another aspect, the disclosure provides a method of constructing a roofing system, the method comprising:

- positioning a first roofing panel according to the disclosure on a roof frame;
- positioning a second roofing panel on the roof frame adjacent to the first roofing panel so as to form a panel seam between the first roofing panel and the second roofing panel.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have noted that attractive conventional roofing structures are difficult and costly to install. The present inventors have recognized that an alternative roofing structure with a desirable aesthetic that can be installed quickly and easily would be attractive to both builders and customers.

Accordingly, one aspect of the disclosure is a roofing structure that forms a roof surface. The roofing structure includes a decking layer providing a structural support for the roofing structure, a base layer disposed over the decking layer, a cap layer disposed over the base layer, and a plurality of rails disposed over the cap layer. The base layer includes a plurality of strips that extend along the roofing structure. The strips of the base layer include a first base layer strip that is adjacent to a second base layer strip so as to form a first base layer seam between the first base layer strip and the second base layer strip. Similarly, the cap layer also includes a plurality of strips that extend over the roofing structure. The strips of the cap layer include a first cap layer strip adjacent to a second cap layer strip so as to form a first cap layer seam between the first cap layer strip and the second cap layer strip. The first cap layer seam is spaced from the first base layer seam across the surface of the roofing structure. The rails are spaced apart across the surface of the roofing structure and include a first rail aligned with the first base layer seam and a second rail aligned with the first cap layer seam.

Figure 1:
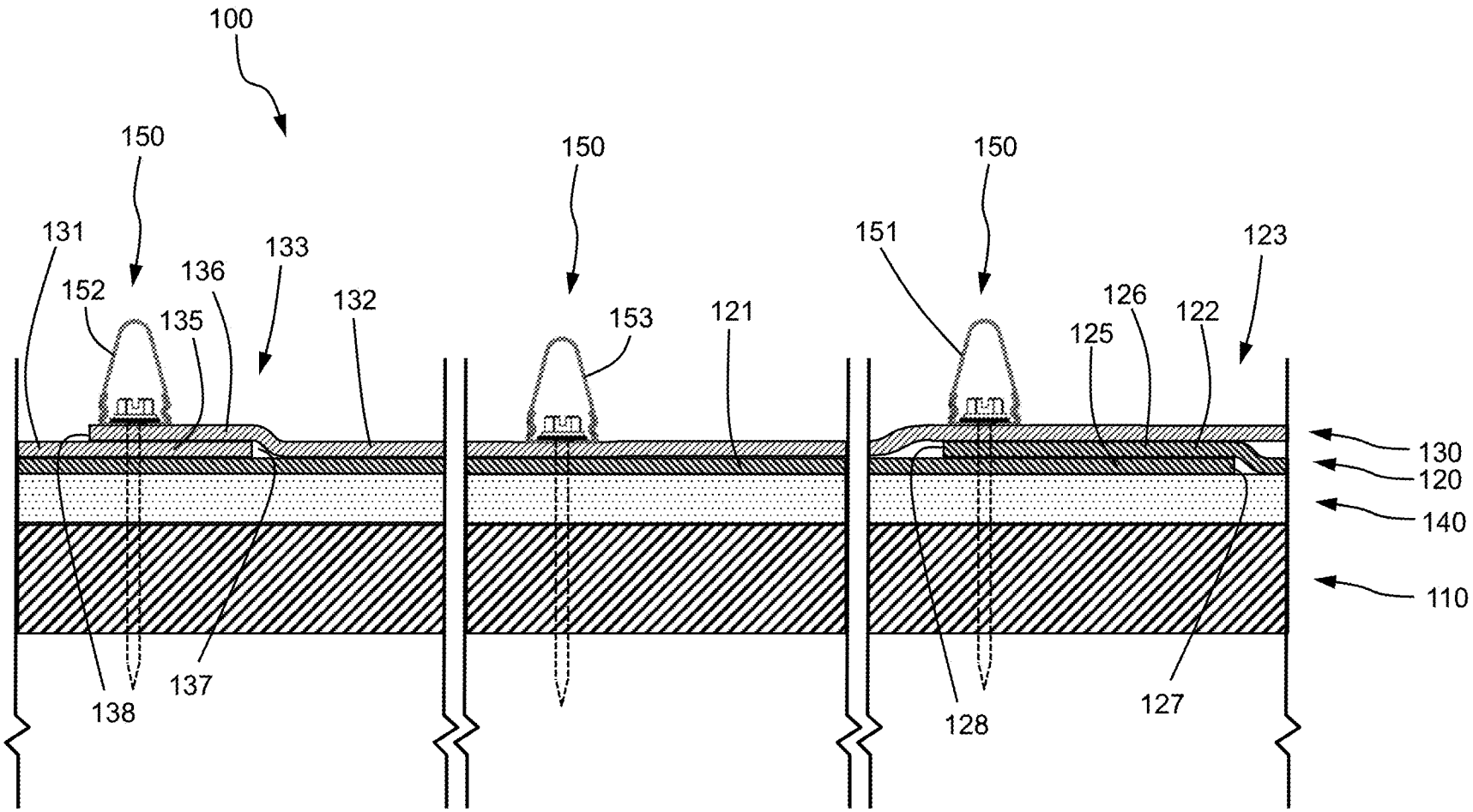
FIG. 1 is a schematic cross-sectional view of a portion of a roofing structure according to an embodiment of the disclosure.
Figure 2:
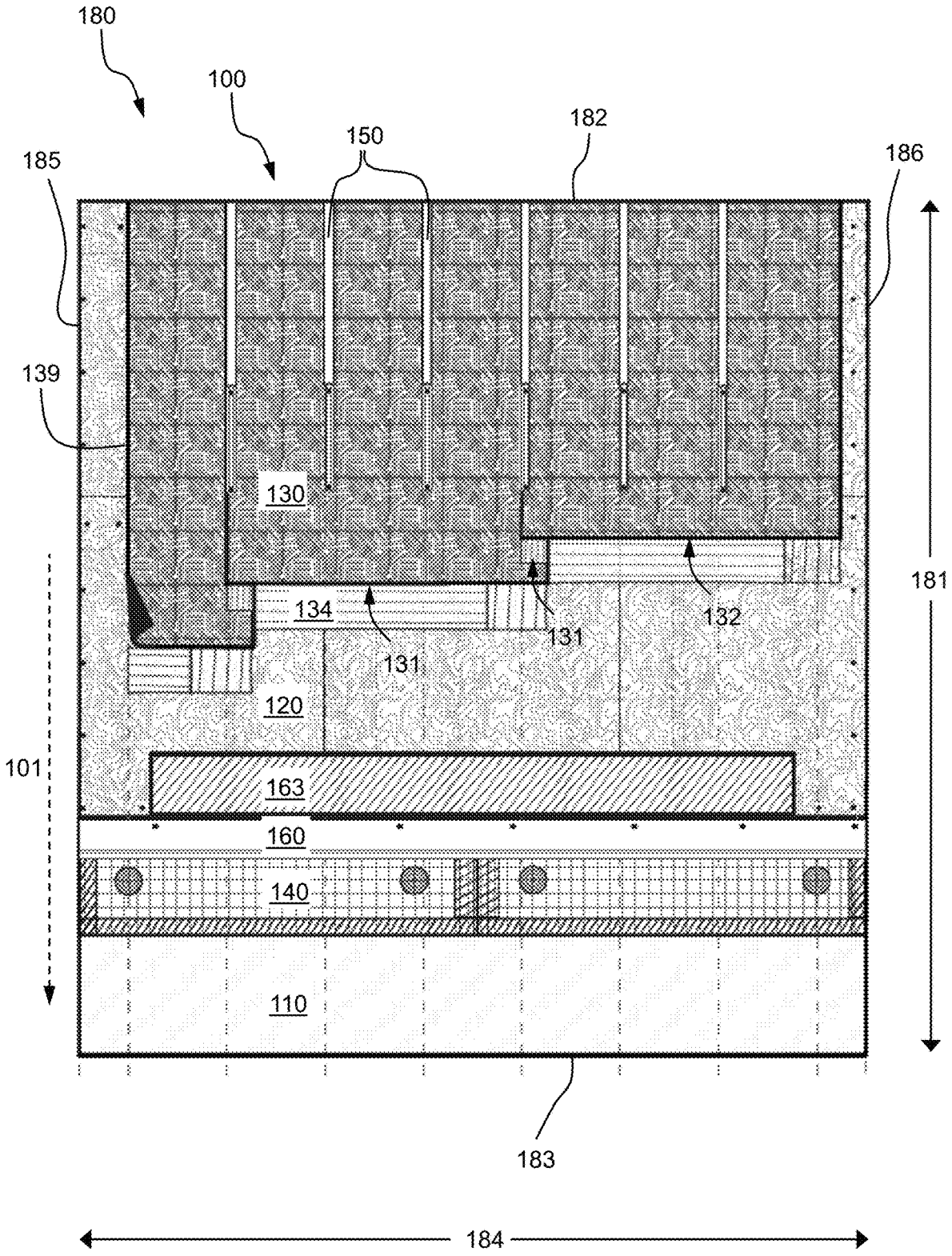
FIG. 2 is a schematic top plan view of the roofing structure of FIG. 1.

A portion of such a roofing structure is shown in a cross-sectional view in FIG. 1. Roofing structure 100 includes a decking layer 110 that provides structural support for the other layers of roofing structure 100. In addition to decking layer 110, roofing structure 100 also includes a base layer 120 disposed over decking layer 110 and a cap layer 130 disposed over base layer 120. A plurality of rails 150 is disposed over the cap layer 130 and spaced apart across the surface of roofing structure 100. Each of base layer 120 and cap layer 130 are formed of a plurality of strips that extend along the roofing structure. FIG. 2 schematically depicts a top plan view of the layers of roofing structure 100. Sections of the strips of the cap layer 130 are staggered in FIG. 2, which helps to illustrate how the strips of the cap layer 130 are positioned across roofing structure 100. The strips of the base layer 120 of roofing structure 100 are similarly arranged.

Each of the layers that is schematically depicted in FIG. 2 is positioned or partially removed to reveal underlying layers. However, in most embodiments, many of the layers extend over substantially all of the length of the roofing surface, i.e., the height of FIG. 2. For example, while FIG. 2 does not show cap layer 130 or base layer 120 extending to the bottom of the image, these layers of roofing structure 100 extend to the lower end of the roofing structure, as explained in more detail below with respect to FIG. 4.

The cross-sectional view of FIG. 1 shows portions of two strips of each of the base layer 120 and cap layer 130. In particular, base layer 120 includes a first base layer strip 121 and a second base layer strip 122. First base layer strip 121 and second base layer strip 122 are adjacent to one another so as to form a first base layer seam 123 where the strips meet. Similarly, cap layer 130 includes a first cap layer strip 131 and a second cap layer strip 132 that are adjacent to each other and form a first cap layer seam 133. First base layer seam 123 and first cap layer seam 133 are spaced apart from one another across the surface of roofing structure 100. Each of the first base layer seam 123 and first cap layer seam 133 is associated with one of the rails 150. Specifically, a first rail 151 is aligned with first base layer seam 123 and a second rail 152 is aligned with cap layer seam 133. It should be understood that the first base layer seam 123 is spaced apart from the first cap layer seam 133 and is not aligned with a different cap layer seam. In other words, the seams within the base layer and cap layer are staggered and spaced apart, such that the nearest base layer seam and cap layer seam are spaced apart latterly across the roofing surface.

In some embodiments the arrangement of the rails over the cap layer gives the appearance of a standing seam roof configuration. Accordingly, embodiments of the disclosure can provide an attractive roofing structure that has the visual of a standing seam roof, but that uses layers with strips of material that are wider than the distance between neighboring rails. In particular, within a layer of the roofing structure, the distance across the roof from one seam to the next may extend over several of the rails. This allows for a roofing structure that can be installed efficiently, by enabling wide sections of each layer to be assembled in the roofing structure in a single operation.

In certain embodiments of the roofing structure as otherwise described herein, the roofing structure also includes a fire-resistant layer disposed between the decking layer and the base layer. For example, roofing structure 100 includes a fire-resistant layer 140 disposed between decking layer 110 and the base layer 120. Thus, while the base layer 120 is over the decking layer 110, the base layer 120 is not immediately adjacent to the decking layer 110. In other embodiments, the fire-resistant layer is located in another position within the layers.

Likewise, in some embodiments, the cap layer is disposed directly on top of the base layer. For example, in roofing structure 100, cap layer 130 is adhered to base layer 120 using a sealant, as described further below. In other embodiments, the cap layer is positioned over the base layer, but one or more additional layers is disposed between the cap layer and the base layer.

Further, while some embodiments of the roofing structure include a specific fire-resistant layer that has unique fire-resistant properties, some embodiments also, or alternatively, include fire-resistant features in one or more of the decking layer, base layer, or cap layer. For example, these layers can include fire-resistant additives or have configurations that aid in controlling a fire.

In certain embodiments of the roofing structure as otherwise described herein, the fire-resistant layer includes gypsum. For example, in some embodiments, the fire-resistant layer is a layer of gypsum that is applied directly onto the decking layer. In other embodiments, the fire-resistant layer is a gypsum board including a gypsum core between two facing sheets, such as paper or fiberglass sheets. In other embodiments, the fire-resistant layer includes cementitious glass mat facers, or other facing sheets.

In certain embodiments of the roofing structure as otherwise described herein, the fire-resistant layer is attached to the decking layer using mechanical fasteners. For example, fire-resistant layer 140 of roofing structure 100 is a gypsum board that is attached to decking layer 110 with mechanical fasteners. Such mechanical fasteners can include screws, nails or other fasteners, and may also include washers or plates to further brace the fire-resistant layer against the decking layer.

In some embodiments, the fire-resistant layer is secured to the decking layer using a sealant. For example, in some embodiments, a sealant is disposed between the fire-resistant layer and the decking layer. For example, such a sealant can be a liquid sealant, such as a rubber cement, or can be a sealing tape. In some embodiments, the sealant is provided around the perimeter of individual segments of the decking layer and fire-resistant layer. In other embodiments, the sealant is provided between the entirety of the two surfaces.

In certain embodiments of the roofing structure as otherwise described herein, the decking layer includes a wood board. For example, in some embodiments, the decking layer is formed from an engineered wood product, such as oriented strand board or particle board. In other embodiments the decking layer is formed of plywood. Alternatively, in some embodiments, the decking layer is formed of a foam board, a gypsum board, or a polymer-based material.

In some embodiments, a single board of the decking layer extends across the roofing structure. In other embodiments, the decking layer is formed by several boards that extend across the roofing structure. In some embodiments the edges of the boards of the decking layer are joined with butt joints. In other embodiments, the edges are overlapping or interlocking.

In certain embodiments of the roofing structure as otherwise described herein, the base layer is formed of a bituminous membrane. For example, in some embodiments, the base layer is configured as an underlayment that is water resistant or waterproof. In some embodiments, the bituminous membrane is formed by a sheet of material, such as felt, fiberglass or another material, that is impregnated or covered with bitumen. In other embodiments, the base layer is formed of a synthetic weather-resistant sheet. For example, in some embodiments the base layer is formed of a synthetic roofing underlayment Such a synthetic sheet may be formed from one or more polymer layers including layers of woven or non-woven polymer fibers and/or polymer films.

As explained above, the base layer is formed of strips that extend along the roofing structure. In some embodiments, each strip of the base layer of the roofing structure is formed as a single continuous piece, while in other embodiments each strip is formed by two or more segments. For example, in some embodiments, each strip is formed by a plurality of segments with overlapping ends along the length of the strip.

In certain embodiments of the roofing structure as otherwise described herein, the base layer is formed of a rollable material. For example, in some embodiments, the base layer is formed of a sheet material that can be rolled without being structurally compromised. Accordingly, prior to installing the base layer within the roofing structure, the base layer can be provided on a roll, which may be convenient for shipping and installation. The term rollable, as used herein, refers to a material that may be rolled on a diameter of 6 feet or less without being structurally compromised, for example without cracking. Further, in some embodiments, the material of the base layer can return from a rolled configuration to a flat configuration under the force of gravity, or without using a specific flattening process. In some embodiments, the rollable material is a bituminous membrane that includes polymeric modifiers in the bitumen to allow the membrane to bend. For example, the membrane may include a bitumen that is modified with SBS (styrene-butadiene-styrene). In other embodiments, the base layer is formed of a rollable synthetic weather-resistant sheet.

In certain embodiments of the roofing structure as otherwise described herein, the base layer includes mineral matter. For example, in some embodiments, the base layer is a bituminous membrane that includes particulates, such as sand or granules. In some embodiments, the particulates are disposed on a surface of the membrane. In other embodiments, the particulates are embedded within the membrane. Further, in some embodiments, the base layer does not include any mineral matter or particulates.

In certain embodiments of the roofing structure as otherwise described herein, a bottom surface of each base layer strip is secured in the roofing structure by adhesion. For example, in some embodiments, the base layer is a self-adhering layer that is adhered to the underlying layer. For example, base layer 120 of roofing structure is self-adhering layer that is attached to fire-resistant layer 140. In some embodiments an adhesive or sealant, such as a rubber flashing cement, is disposed between the base layer and the underlying layer. For example, in some embodiments a sealant is disposed on the lower surface around the perimeter of each segment of the base layer. Accordingly, each segment of the base layer is sealed around its perimeter edges. In other embodiments, a sealant covers the entire lower surface of the base layer. In such an embodiment, a seal is formed under the entire base layer surface. In some embodiments, the base layer is secured to the underlying layer using mechanical fasteners. Such mechanical fasteners can be used in addition to or as an alternative to a sealant or adhesive.

In certain embodiments of the roofing structure as otherwise described herein, the cap layer is formed of a bituminous membrane. For example, in some embodiments, the cap layer is formed of a water resistant or waterproof membrane that includes a sheet of material, such as felt, fiberglass or another material, that is impregnated or covered with bitumen. Similar to the base layer, the cap layer is formed of strips that extend along the roofing structure. In some embodiments, each strip of the cap layer of the roofing structure is formed as a single continuous piece, while in other embodiments each strip is formed by two or more segments. For example, in some embodiments, each strip of the cap layer is formed by a plurality of segments with overlapping ends along the length of the strip.

In certain embodiments of the roofing structure as otherwise described herein, the cap layer is formed of a rollable material. For example, in some embodiments, the cap layer is formed of a sheet material that can be rolled without being structurally compromised. Similar to the rollable base layer, in some embodiments, the rollable material of the cap layer is a bituminous membrane that includes polymeric modifiers in the bitumen to allow the membrane to bend. For example, the membrane of the cap layer may include a bitumen that is modified with SBS.

In certain embodiments of the roofing structure as otherwise described herein, a surface of the cap layer includes mineral matter. For example, in some embodiments, the cap layer includes roofing granules on the upper surface. In some embodiments, the roofing granules may include algae-resistant or UV protecting roofing granules. Further, in some embodiments, the roofing granules are configured to provide a desired aesthetic to the roofing surface. For example, in some embodiments, the roofing granules include a pigment so that the cap layer has a desired color. In some embodiments, the roofing granules may include reflective roofing granules, for example including a metallic or other reflective pigment, in order to keep the roofing structure cool. In some embodiments, the cap layer includes other mineral matter, such as sand or another particulate. Further, in some embodiments, the cap layer also includes mineral matter embedded in the layer. Alternatively, in some embodiments, the cap layer does not include any mineral matter. For example, in some embodiments, the cap layer includes a foil or a coating on the upper surface.

In certain embodiments of the roofing structure as otherwise described herein, a bottom surface of each cap layer strip is sealed around a perimeter of the cap layer strip with a sealant. For example, in some embodiments a sealant, such as rubber flashing cement, is disposed on the lower surface around the perimeter of each segment of the base layer. Accordingly, each segment of the base layer is sealed around its perimeter edges. For example, as shown in FIG. 2, the strips of cap layer 130 of roofing structure 100 are secured along their edges with a rubber flashing cement 134. Likewise, segments of the of the cap layer strips are also sealed at their edges with the rubber flashing cement 134. In other embodiments, a sealant covers the entire lower surface of the base layer. Likewise, in some embodiments, the cap layer is self-adhering. In such embodiments, a seal is formed under the entire cap layer surface. In some embodiments, the cap layer is secured to the other layers of the roofing structure using mechanical fasteners. Such mechanical fasteners can be used in addition to or as an alternative to a sealant or adhesive.

In certain embodiments of the roofing structure as otherwise described herein, the first base layer seam is an overlapping seam including an overlapping portion of the second base layer strip disposed over an underlapping portion of the first base layer strip. For example, as shown in FIG. 1, the first base layer seam 123 of base layer 120 of roofing structure 100 includes an overlapping portion 126 along a first edge 128 of second base layer strip 122 that is disposed over an underlapping portion 125 along a second edge 127 of the first base layer strip 121. In FIG. 2, the overlap between the first and second base layer strips 121, 122 is positioned between the first edge 128 of second base layer strip 122 and the covered second edge 127 of first base layer strip 121. The seams between other neighboring strips of the base layer may also include such an overlap. The overlap between the strips lengthens the path that any water needs to travel to penetrate the base layer.

In certain embodiments of the roofing structure as otherwise described herein, the overlap of the overlapping portion of the second base layer strip and the underlapping portion of the first base layer strip is at least 2 inches, e.g., at least 4 inches, e.g., about 6 inches. Further, in certain embodiments of the roofing structure as otherwise described herein, the overlap of the overlapping portion of the second base layer strip and the underlapping portion of the first base layer strip is no more than 12 inches, no more than 10, no more than 8. For example, in some embodiments, the overlap of the first base layer strip and the second base layer strip is in a range from 2 inches to 12 inches, e.g., from 4 inches to 10 inches, e.g., from 6 inches to 8 inches.

In certain embodiments of the roofing structure as otherwise described herein, the overlapping portion of the second base layer strip is adhered to the underlapping portion of the first base layer strip. For example, in some embodiments the segments of the base layer are self-adhering, and the overlapping portion of the second base layer strip adheres to underlapping portion of the first base layer strip when the second base layer strip is applied onto the first base layer strip. In other embodiments a sealant, such as rubber flashing cement, is applied between the underlapping portion of the first base layer strip and the overlapping portion of the second base layer strip. Thus, the overlap allows for a substantial seal to be provided around the seams of the base layer to help avoid water intrusion.

In certain embodiments of the roofing structure as otherwise described herein, the first rail is disposed over the overlapping portion of the second base layer strip. For example, in roofing structure 100, first rail 151 is positioned directly on top of cap layer 130 and over the overlap within base layer 120 that is formed by first base layer strip 121 and second base layer strip 122. Specifically, first rail 151 is disposed over the overlapping portion 126 of the second base layer strip 121 and the underlapping portion 125 of the first base layer strip 121. The position of the first rail 151 over the overlap within the base layer 120 helps to obscure any visual evidence of the first base layer seam 123 that would otherwise be apparent through the cap layer 130.

In certain embodiments of the roofing structure as otherwise described herein, the first rail is disposed at a side edge of the second base layer strip. For example, in some embodiments, the first rail is positioned so that it lies over the overlap in the base layer, with a side of the first rail aligned with the side edge of the second base layer strip that forms part of the overlapping portion of the second base layer strip. Accordingly, the first rail can obscure any ridge in the cap layer that would otherwise be visible where the cap layer extends over the edge of the second base layer strip. For example, in roofing structure 100, first rail 151 is positioned so that one side of first rail 151 is aligned with the first edge 128 of second base layer strip 122, which hides the bump in cap layer 130 where it extends over the first edge 128.

In certain embodiments of the roofing structure as otherwise described herein, the first cap layer seam is an overlapping seam including an overlapping portion of the second cap layer strip disposed over an underlapping portion of the first cap layer strip. For example, as shown in FIG. 1, the first cap layer seam 133 of cap layer 130 of roofing structure 100 includes an overlapping portion 136 along a first edge 138 of second cap layer strip 132 that is disposed over an underlapping portion 135 along a second edge 137 of the first cap layer strip 131. In FIG. 2, the overlap between the first and second cap layer strips 131, 132 is shown between the first edge 138 of second cap layer strip 132 and the covered second edge 137 of first cap layer strip 131. The seams between other neighboring strips of the cap layer may also include such an overlap. Similar to the base layer, the overlap between the strips of the cap layer lengthens the path that any water needs to travel to penetrate the cap layer.

In certain embodiments of the roofing structure as otherwise described herein, the overlap of the overlapping portion of the second cap layer strip and the underlapping portion of the first cap layer strip is at least 1 inch, e.g., at least 2 inches, e.g., about 3 inches. Moreover, in certain embodiments of the roofing structure as otherwise described herein, the overlap of the overlapping portion of the second cap layer strip and the underlapping portion of the first cap layer strip is no more than 8 inches, e.g., no more than 6 inches, e.g., no more than 4 inches. For example, in some embodiments, the overlap of the first cap layer strip and the second cap layer strip is in a range from 1 inch to 8 inches, e.g., from 2 inches to 6 inches, e.g., from 3 inches to 4 inches.

In certain embodiments of the roofing structure as otherwise described herein, sealant is disposed between the overlapping portion of the second cap layer strip and the underlapping portion of the first cap layer strip. For example, in some embodiments a sealant, such as rubber flashing cement, is applied between the portions of the cap layer strips that overlap. Accordingly, the overlap allows for a substantial seal to be provided around the seams of the cap layer to help avoid water intrusion. In other embodiments, the segments of the cap layer may be a self-adhering such that the overlapping portion of the second cap layer strip adheres to the underlapping portion of the first cap layer strip when it is applied over the edge of the second cap layer strip.

In certain embodiments of the roofing structure as otherwise described herein, the second rail is disposed over the overlapping portion of the second cap layer strip. For example, in roofing structure 100, second rail 152 is positioned directly on top of the overlapping portion 136 of second cap layer strip 132. Likewise, second rail 152 is also positioned over the underlapping portion 135 of first cap layer strip 131. The position of the second rail 152 over the overlap of first cap layer seam 133 helps to obscure any visual evidence of the first cap layer seam 133.

In certain embodiments of the roofing structure as otherwise described herein, the second rail is disposed at a side edge of the second cap layer strip. For example, in some embodiments, a side of the second rail is aligned with the side edge of the exposed side edge of the second cap layer strip, which helps obscure the exposed edge of the cap layer. For example, in roofing structure 100, second rail 152 is positioned so that one side of second rail 152 is aligned with the first edge 138 of second cap layer strip 132, which obscures the exposed first edge 138.

In certain embodiments of the roofing structure as otherwise described herein, the plurality of rails includes a third rail that is spaced from the seams of the base layer and the seams of the cap layer. For example, in some embodiments, a portion of the rails of the roofing structure are aligned with seams of the base and cap layers while another portion of the rails is not aligned with the seams. For example, while the first and second rails 151, 152 of roofing structure 100 are aligned with the first base layer seam 123 and first cap layer seam 133, respectively, roofing structure 100 also includes a third rail 153 that is spaced from both seams 123, 133 and not aligned with a seam of either layer. Such a configuration allows the rails to be evenly spaced across the roofing structure without limiting the width of the cap layer or base layer. While the illustrated embodiment of roofing structure shows a single rail between the first base layer seam and the first cap layer seam, in other embodiments multiple rails may be positioned between these seams. On the other hand, in other embodiments, the strips of the base layer and cap layer are narrower, such that a rail is disposed over each seam.

In certain embodiments of the roofing structure as otherwise described herein, each of the strips of the base layer and the cap layer extend in a first direction. For example, as shown in FIG. 2, the strips of the base layer 120 and cap layer 130 extend parallel to one another along a first direction 101. Further, in certain embodiments of the roofing structure as otherwise described herein, each of the rails extend in the first direction. For example, in roofing structure 100, the rails 150 also extend along the first direction 101, such that the strips of the base layer 120, the strips of the cap layer 130, and the rails 150 are all parallel.

In some embodiments, the first direction extends from a higher elevation to a lower elevation. Thus, in such embodiments the rails and the strips extend from the higher elevation to the lower elevation. For example, in some embodiments, the first direction extends from a ridge to an eave. In other embodiments, the first direction from another elevated location, such as a hip. Similarly, in some embodiments, the first direction extends to another location of reduced elevation, such as a valley. On the other hand, in some embodiments, the strips of the base layer and cap layer and the rails extend across the roofing structure without changing elevation.

In certain embodiments of the roofing structure as otherwise described herein, the rails are regularly spaced from one another across the roofing structure. For example, as shown in FIG. 2, the rails 150 are spaced across roofing structure 100 at regular intervals and forming a regular pattern of the rails. As explained in more detail below, the regular spacing of the rails and the parallel configuration of the strips of the base layer and cap layer facilitate the use of the roofing structure with a custom grid. For example, in some embodiments, the roofing structure is designed such that components of the roofing structure follow the lines of a grid structure, which allows the implementation of the roofing structure within a building designed on the grid to be efficient and uncomplicated.

Figure 3:
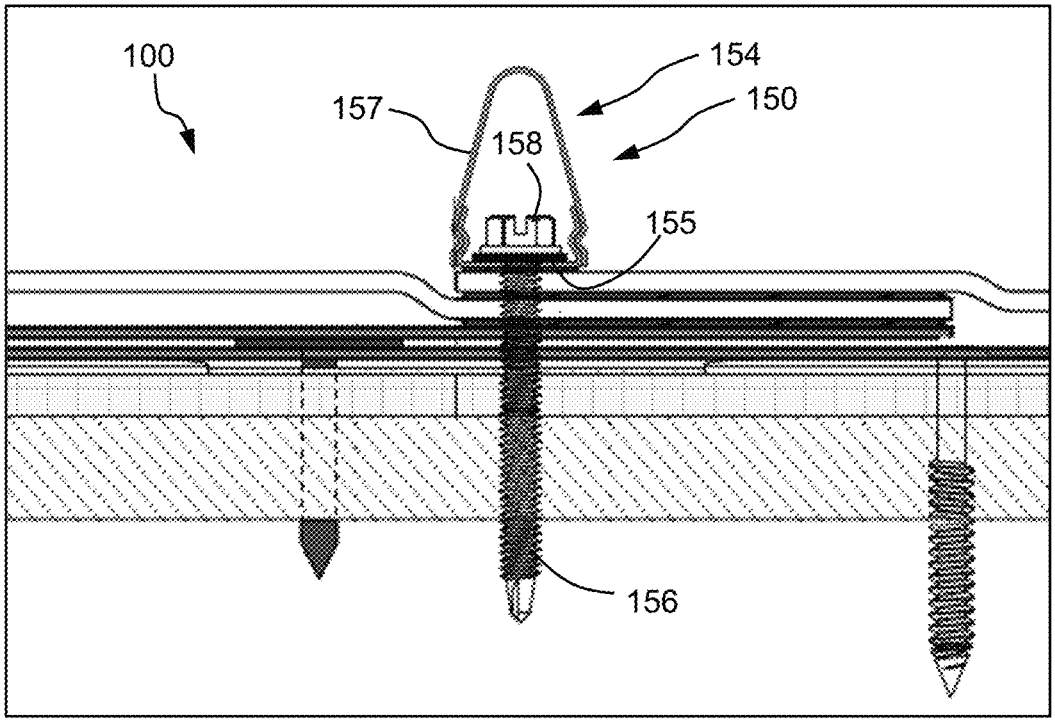
FIG. 3 is a detailed schematic cross-section view of a portion of the roofing structure of FIG. 1.

In certain embodiments of the roofing structure as otherwise described herein, each of the rails includes a batten that is secured to the decking layer using a group of mechanical fasteners spaced along the length of the batten. For example, FIG. 3 shows a more detailed view of a rail of the roofing structure 100. Rail 154 has the same configuration as first rail 151, second rail 152, and third rail 153 shown in FIGS. 1 and 2. Further, rail 154 is similarly disposed on top of cap layer 130 above base layer 120, decking layer 110 and fire-resistant layer 140. Rail 154 includes a batten 155 that lies on the surface of cap layer 130. Further, the batten 155 is secured to the layers of roofing structure 100 by a group of mechanical fasteners 156 that are spaced in a line along the length of the batten 155. The mechanical fasteners 156 extend through the layers of the roofing structure and engage with the decking layer 110 to securely hold the batten 155, and corresponding rail 154, in place.

In certain embodiments of the roofing structure as otherwise described herein, each of the rails includes a cap configured to cover the batten. For example, rail 154, as shown in FIG. 3, includes a cap 157 that clips over batten 155. The cap 157 imparts the visible design of the rail, for example, allowing the rails to provide a standing-seam appearance. While the cap 157 of rail 154 clips to batten 155, in other embodiments, the cap may be secured over the batten by another manner. For example, in some embodiments, the cap is secured to the mechanical fasteners. Further, in some embodiments, the cap is secured to the batten using adhesive. Other attachment methods are also possible.

In certain embodiments of the roofing structure as otherwise described herein, the cap of each rail has a triangular configuration. For example, the cross section of the cap 157 of the rail 154 includes a rounded triangular configuration with two opposing sides that extend upward toward a rounded point. Such a configuration provides an elegant and clean appearance. In other embodiments, the cap has cross section with a different shape. For example, in some embodiments, the cap has a semi-circular or rectangular cross-sectional shape.

In certain embodiments of the roofing structure as otherwise described herein, the cap of each rail encloses an interior space and the fastener heads of the respective group of mechanical fasteners is disposed within the interior space. For example, as shown in FIG. 3, the rails 150 of roofing structure 100 include a cap 157 that is hollow and forms an open interior space. This allows the cap 157 to hide the fastener heads 158 of the mechanical fasteners 156 by positioning the fastener heads 158 under the cap 157 and inside the hollow interior space. Accordingly, the mechanical fasteners can be relatively large without ruining the clean aesthetic of the roofing surface.

In certain embodiments of the roofing structure as otherwise described herein, the rails include metal. For example, in some embodiments each of the rails includes sheet metal, such as steel or aluminum. In roofing structure 100, for example, each of the batten 155 and cap 157 is formed of bent sheet metal. In other embodiments, the rails include polymer material or wood. Further, in some embodiments, the rails are formed of more than one material, such as a layered structure including plastic and metal.

Figure 4:
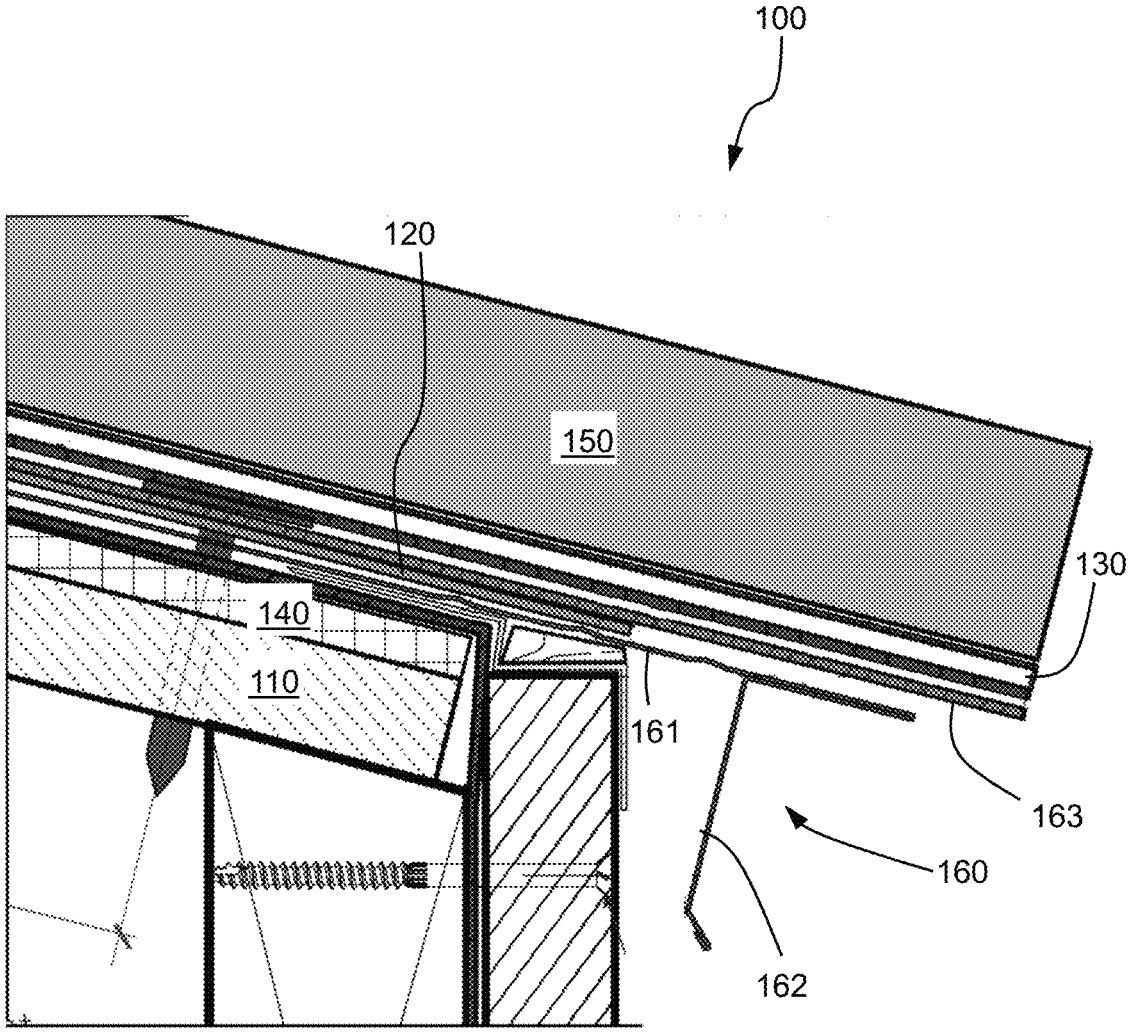
FIG. 4 is a schematic side view a lower end of the roofing structure of FIG. 1

In certain embodiments of the roofing structure as otherwise described herein, a lower end of the roofing structure includes an eave. For example, as shown in FIG. 2, the lower end of roofing structure 100 is a free end in the form of an eave that is configured to overhang the outer wall of a structure covered by the roofing structure 100. FIG. 4 shows a cross-sectional side view of the lower end of roofing structure 100, including a decking layer 110, a fire-resistant layer 140, a base layer 120, a cap layer 130 and a rail 150. The layers of roofing structure 100 form an eave at the lower end, as shown in FIG. 4.

In certain embodiments of the roofing structure as otherwise described herein, a flashing element is disposed at the lower end, and wherein a portion of the flashing element is disposed between the decking layer and the base sheet layer. For example, as shown in FIG. 2, the lower end of roofing structure 100 includes a flashing element in the form of a drip edge 160 that extends across the roofing structure. The position of the drip edge 160 in FIG. 2 indicates that the drip edge is disposed over the decking layer 110 and fire-resistant layer 140 but under the base layer 120 and cap layer 130.

The position of drip edge 160 is also shown in FIG. 4. Drip edge 160 includes a roof leg 161 that is positioned between the fire-resistant layer 140 and the base layer 120 and a vertical leg 162 that extends over the lower edge of the fire-resistant layer 140 and decking layer 110. In other embodiments, the flashing element at the lower end of the roofing structure has other configurations.

In certain embodiments of the roofing structure as otherwise described herein, a shingle is disposed between the base layer and the cap layer at the lower end of the roofing structure. For example, as shown in FIG. 2, roofing structure 100 includes a shingle 163 that is disposed between the base layer 120 and cap layer 130 at the lower end of roofing structure 100. FIG. 4 also shows the position of shingle 163 between base layer 120 and cap layer 130. The shingle provides an additional layer of weather-resistant coverage for the roofing system at the lower end of roofing structure 100. In some embodiments, the shingle is configured as a starter shingle, and is covered with an adhesive to form a strong bond with the overlapping cap layer.

Figure 5:
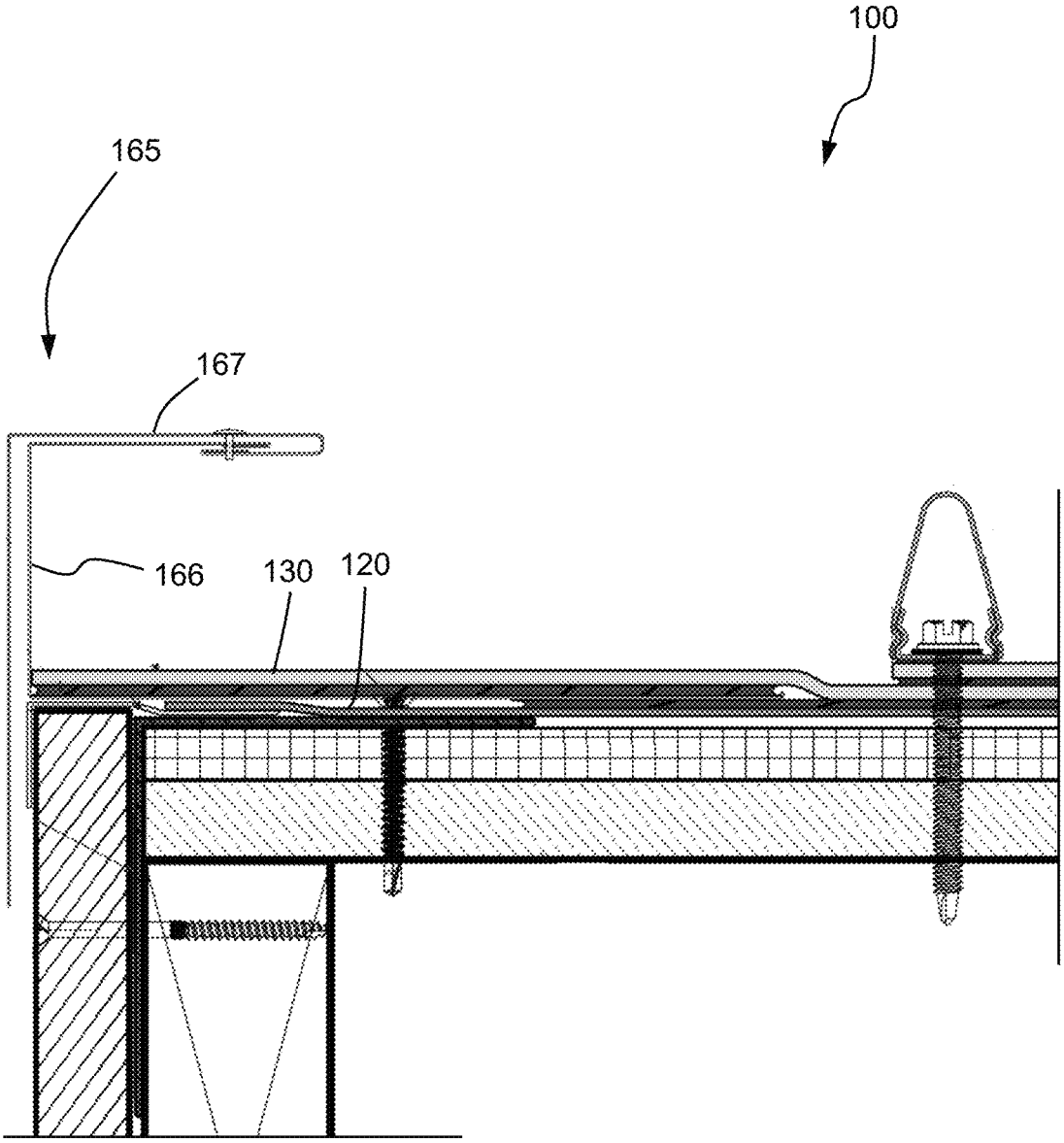
FIG. 5 is a schematic cross-sectional view of a lateral edge of the roofing structure of FIG. 1.

In certain embodiments of the roofing structure as otherwise described herein, an upper end of the roofing structure includes a two-piece flashing assembly, including an inner flashing element having a portion that extends under the cap sheet layer and an outer flashing element that extends over the inner flashing element. Similarly, in certain embodiments of the roofing structure as otherwise described herein, a rake edge of the roofing structure includes a two-piece flashing assembly, including an inner flashing element having a portion that extends under the cap sheet layer and an outer flashing element that extends over the inner flashing element. For example, roofing structure 100 includes a rake edge 165 including such a configuration, as shown in FIG. 5. As shown in FIG. 5, the rake edge 165 of roofing structure 100 includes a two-piece flashing assembly that has an inner flashing element 166 and an outer flashing element 167. The inner flashing element 166 has a U-shaped configuration including a lower leg that extends under the cap layer 130 and an upper leg that curves back over the cap layer 130. The outer flashing element 167 is secured to the upper leg of the inner flashing element 166 and includes a portion that extends outward over the outer edge of the decking layer 110. The edge at the upper end of roofing structure 100 has a similar configuration using a two-piece flashing assembly. While the embodiment depicted in FIG. 5 shows the lower leg of the inner flashing element between the base layer and cap layer, in other embodiments, the lower leg of the inner flashing element is positioned under both layers. Further still, in other embodiments the two elements of the two-piece flashing assembly have other shapes and configurations.

In another aspect, the disclosure provides a roofing panel that includes the roofing structure of the disclosure. In some embodiments the roofing structure described above is provided on a single roofing panel. In other embodiments, as described in more detail below, the roofing structure is formed by two or more roofing panels. In some embodiments, the lateral edges of the roofing panel are defined by the decking layer. In other words, in some embodiments, the lateral edges of the board or boards that form the decking layer define the lateral edges of the roofing panel. In other embodiments, the roofing panel includes a frame below the decking layer that supports one or more boards of the decking layer. For example, some embodiments include a frame of framing lumber, metal bars or other structural members that support the layers of the roofing structure. In some embodiments this support frame defines the lateral edges of the roofing panel.

FIG. 2 illustrates the roofing structure 100 included in a roofing panel 180. Roofing panel 180 includes each of the decking layer 110, fire-resistant layer 140, base layer 120, cap layer 130, and rails 150. Roofing panel 180 has a length 181 that extends from an upper end 182 to a lower end 183 and a width 184 that extends from a first lateral edge 185 to a second lateral edge 186.

Providing the roofing structure of the disclosure as part of a roofing panel allows the roofing structure to be installed quickly, easily and with fewer errors. For example, rather than installing each layer of the roofing structure separately, builders can simply position the panels in the appropriate location on the roofing frame and install a majority of the roofing structure by simply securing the roofing panels to the roofing frame. For example, in some embodiments, installation of the roofing panels provides more than 50% of the overall roof installation, e.g., more than 60%, e.g., more than 70%, e.g., more than 80%.

In certain embodiments of the roofing panel as otherwise described herein, an edge of the cap layer is set back from the first lateral edge. For example, in roofing panel 180, base layer 120 extends across the width 184 from first lateral edge 185 to second lateral edge 186. In contrast, cap layer 130, extends across most of the width 184 of roofing panel 180, but the outer edges of the cap layer 130 are spaced from the lateral edges 185, 186 of the roofing panel 180. In particular, edge 139 of cap layer 130 is set back from first lateral edge 185 of roofing panel 180. The gap in cap layer 130 at the first lateral edge 185, allows seam covering strip to extend from one panel to another over the seam formed between the panels, as explained in more detail below.

In certain embodiments of the roofing panel as otherwise described herein, a width of the roofing panel is at least 3 feet, e.g., at least 4 feet, e.g., at least 6 feet. Further, in certain embodiments of the roofing panel as otherwise described herein, a width of the roofing panel is no more than 20 feet, e.g., no more than 15 feet, e.g., no more than 10 feet. For example, in some embodiments, the width of the roofing panel is in a range from 3 feet to 20 feet, e.g., from 4 feet to 15 feet, e.g., from 6 feet to 10 feet.

In certain embodiments of the roofing panel as otherwise described herein, a length of the roofing panel is at least 6 feet, e.g., at least 8 feet, e.g., at least 10 feet. Further, in certain embodiments of the roofing panel as otherwise described herein, a length of the roofing panel is no more than 100 feet, e.g., no more than 80 feet, e.g., no more than 60 feet. For example, in some embodiments, the length of the roofing panel is in a range from 6 feet to 100 feet, e.g., from 8 feet to 80 feet, e.g., from 10 feet to 60 feet.

In certain embodiments of the roofing panel as otherwise described herein, the roofing panel is configured for installation in a range of slopes from $^{2}/_{12}$ to $^{7}/_{12}$. For example, in some embodiments, the roofing panel is configured so that it can be attached to an existing roof frame with a pitch ranging from a low slope of $^{2}/_{12}$ to a slope of $^{7}/_{12}$. In some embodiments, the slope of the roof is $^{3}/_{12}$ or $^{5}/_{12}$.

In certain embodiments of the roofing panel as otherwise described herein, the roofing panel meets UL Class A fire resistance standards according to ASTM E108 Standard Test Methods for Fire Tests of Roof Coverings when installed at a slope of $^{2}/_{12}$, when installed at a slope of $^{5}/_{12}$, and when installed at a slope of $^{7}/_{12}$. For example, in some embodiments, the roofing panel is configured to pass a burning brand test when installed at either a $^{2}/_{12}$ slope or a $^{5}/_{12}$. The ability of the panel to pass such a test may be aided, at least in part, by the inclusion of a fire resistant layer within the roofing structure, as described above. Further, in some embodiments, the roofing panel is configured to pass a spread of flame or intermittent flame test whether installed at a slope of 2/12 or a slope of 5/12. The ability of the panel to pass these tests may be aided, at least in part, by the overlap of the strips within the base layer and cap layer, and the spacing of the seams between the base layer and the cap layer, as described above.

In some embodiments, the roofing panel includes the flashing described above at the upper end, lower end, or along a lateral edge of the roofing panel. In other embodiments, the roofing panel includes an unfinished edge that is finished upon installation. The inclusion of the flashing and a finished edge can reduce the time and complexity of installing the roofing panel on a roofing frame. On the other hand, an unfinished edge may allow several panels to be used along the length of a roofing system.

Figure 6:
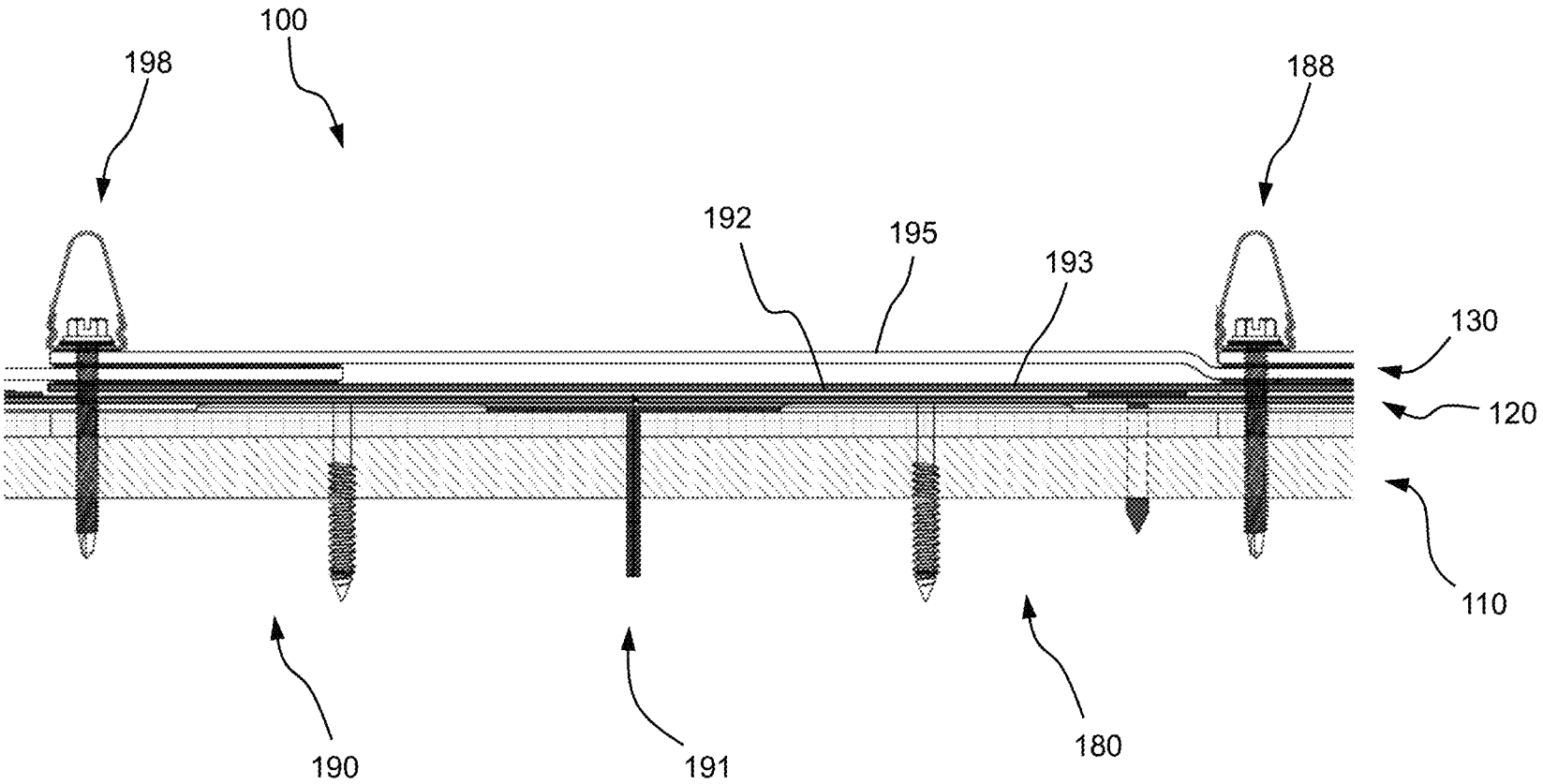
FIG. 6 is a schematic cross-sectional view of a panel seam of the roofing structure of FIG. 1.

As mentioned above, in some embodiments, the roofing structure includes a first roofing panel and a second roofing panel adjacent to the first roofing panel so as to form a panel seam, and the first base layer strip, the second base layer strip, the first cap layer strip, and the second cap layer strip are all part of the first roofing panel. For example, in some embodiments, two roofing panels are placed adjacent to one another to form a panel seam, and the roofing structure includes layers and elements that span the panel seam to form a continuous roofing surface. Such an embodiment is shown in FIG. 6, which uses roofing panel 180, as described above and shown in more detail in FIG. 2, and which includes the layers and features shown in FIGS. 1-5. A second roofing panel 190 having a similar configuration is disposed adjacent to roofing panel 180 to form a panel seam 191.

In certain embodiments of the roofing structure as otherwise described herein, a lower end of the roofing structure includes a shingle that extends from the first roofing panel to the second roofing panel so as to overlap the panel seam, and wherein the shingle is disposed over the base layer and under the cap layer. For example, as shown in FIG. 6, roofing structure 100 includes an overlapping shingle 192 that is disposed between the base layer 120 and cap layer 130 at the lower end of roofing structure 100 and extends from first roofing panel 180 to second roofing panel 190. The shingle provides a layer of weather-resistant coverage over the panel seam 191 at the lower end of the roofing structure 100. In some embodiments, the shingle is configured as a starter shingle, and is covered with an adhesive to form a strong bond with the overlapping cap layer.

In certain embodiments of the roofing structure as otherwise described herein, the roofing structure includes a seam covering layer extending over the base layer of the first roofing panel and the base layer of the second roofing panel so as to overlap the panel seam. For example, in some embodiments, the roofing structure includes a seam covering layer that seals over the gap in the base layer that is formed by the panel seam. For example, at the panel seam 191 of roofing structure 100, as shown in FIG. 6, a seam covering layer 193 overlaps the panel seam 191 and is secured to the base layer 120 on the first roofing panel 180 and is secured to the base layer 120 on the second roofing panel 190 so as to form a continuous protective layer across the panel seam.

In certain embodiments of the roofing structure as otherwise described herein, a lower end of the panel includes a flashing element that extends from the first roofing panel to the second roofing panel so as to overlap the panel seam. For example, in some embodiments, the roofing structure includes a drip edge similar to that described above, that extends across the first roofing panel and the second roofing panel.

In certain embodiments of the roofing structure as otherwise described herein, the cap layer includes a seam cap layer strip that covers the panel seam. For example, as shown in FIG. 6, the roofing structure 100 includes a seam cap layer strip 195 that forms part of the cap layer 130 and extends from the first roofing panel 180 to the second roofing panel 190 over the panel seam 191.

In certain embodiments of the roofing structure as otherwise described herein, the seam cap layer strip is covered by no more than two of the rails. For example, in some embodiments the seam cap layer strip is relatively narrow so that it does not extend over multiple rails of the roofing structure. Accordingly, this can limit the complexity of the installation of the seam cap layer strip, and reduce the number of rails that need to be installed after the seam cap layer strip is in place.

In certain embodiments of the roofing structure as otherwise described herein, components of the roofing structure are aligned with a custom grid. For example, in some embodiments, the roofing structure is configured so that various layers and elements of the roofing structure will align with a geometric grid that is used to design the roofing structure and the building that supports it. For example, in some embodiments, each of the plurality of rails is aligned with an axis of the custom grid. Likewise, in some embodiments, at least one edge of each strip of the base layer is aligned with an axis of the custom grid. Further, in some embodiments, at least one edge of each strip of the cap layer is aligned with an axis of the custom grid. Similarly, in some embodiments, at least one of the lateral edges or a center of the decking layer is aligned with an axis of the custom grid.

In some embodiments, the grid is a rectangular grid. For example, in some embodiments, the grid includes a first set of parallel axes that are 12 inches apart and a second set of parallel axes that are perpendicular to the first and are also 12 inches apart.

In certain embodiments of the roofing structure as otherwise described herein, the roofing structure has a slope of at least 2/12, e.g., 3/12, e.g., 5/12, e.g., 7/12.

In certain embodiments of the roofing structure as otherwise described herein, the roofing structure meets UL Class A fire resistance standards. For example, in some embodiments, the roofing structure has a 2/12 slope and meets UL Class A fire resistance standards. In other embodiments, the roofing structure has a 5/12 slope an meets UL Class A fire resistance standards. Further, in some embodiments, the roofing structure has a 7/12 slope and meets UL Class A fire resistance standards. For example, in embodiments of the disclosure, the roofing structure is configured to pass a burning brand test, a spread of flame test, and an intermittent flame test.

In another aspect, the disclosure provides a method of constructing a roofing system. The method includes positioning a first roofing panel according to the disclosure on a roof frame and positioning a second roofing panel on the roof frame adjacent to the first panel so as to form a panel seam between the first roofing panel and the second roofing panel.

In certain embodiments of the method as otherwise described herein, the method also includes securing a shingle over a base layer of the first panel and over a base layer of the second panel so as to overlap the panel seam at a lower end of the roofing system. For example, in some embodiments, a shingle such as overlapping shingle 192 of roofing structure 100 is inserted under the cap layer 130 so as to extend over the panel seam 191. In some embodiments, the shingle is secured to the decking layer using mechanical fasteners. Further, in some embodiments, the shingle is adhered to the base layer. Further, in some embodiments, the cap layer, such as cap layer 130, is adhered to the shingle so as to form a group of sealed layers at the lower end of the roofing structure.

In certain embodiments of the method as otherwise described herein, the method also includes covering the panel seam with a seam covering layer disposed over the base layer of the first roofing panel and a base layer of the second roofing panel. For example, in some embodiments, before the cap layer is finished, a seam covering layer, such as seam covering layer 193 of roofing structure 100 shown in FIG. 6, is placed over the panel seam and connected to the base layer of the first roofing panel 180 and the base layer of the second roofing panel 190.

In certain embodiments of the method as otherwise described herein, the method also includes securing a seam cap layer strip over the base layer of the first roofing panel and over a base layer of the second roofing panel so as to cover the panel seam. For example, in some embodiments, once the roofing panels are adjacent, the panel seam can be covered and hidden by a seam cap layer strip, such as seam cap layer strip 195 of roofing structure 100, that extends from the first roofing panel to the second roofing panel.

In certain embodiments of the method as otherwise described herein, securing the seam cap layer strip includes forming a first overlap region between the seam cap layer strip and the first cap layer strip of the first roofing panel and a second overlap region between the seam cap layer strip and a cap layer strip of the second roofing panel. For example, in some embodiments, the cap layer is sealed across the panel seam by using overlapping seams where the seam cap layer strip contacts neighboring cap layer strips.

In certain embodiments of the method as otherwise described herein, the method also includes attaching a first installation rail over the cap layer of the first roofing panel. Further, in certain embodiments of the method as otherwise described herein, the method also includes attaching a second installation rail over a cap layer of the second roofing panel. For example, in some embodiments, after the seam cap layer strip two installation rails are secured over the seam cap layer strip to hide the edges of the seam cap layer strip. For example, after seam cap layer strip 195 of roofing structure 100 is installed, a first installation rail 188 is attached over the cap layer of the first roofing panel 180 and a second installation rail 198 is attached over the cap layer of the second roofing panel 190.

In certain embodiments of the method as otherwise described herein, the first installation rail is positioned at a predetermined distance from an existing rail of the first roofing panel, wherein the second installation rail is positioned at the predetermined distance from the first installation rail, and wherein an existing rail of the second roofing panel is positioned at the predetermined distance from the second installation rail. For example, in some embodiments, the first and second installation rails are positioned to maintain an even spacing of the rails across the roofing structure that spans both the first roofing panel and the second roofing panel.

In certain embodiments of the method as otherwise described herein, the first roofing panel is positioned on the roofing frame at an installation location, and the method further includes fabricating the first roofing panel at a first location and transporting the first roofing panel to the installation location. For example, in some embodiments, the roofing panels are manufactured at one location, such as a manufacturing facility. At the manufacturing facility, most or all of each of the layers is installed on the panel using efficient and accurate manufacturing methods. The roofing panels are then transported to an installation location, such as a residential construction site. At the installation location the roofing panels are installed on the roofing frame so as to install all of the layers of the roofing structure in a single operation.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

Embodiments

Embodiment 1. A roofing structure that forms a roof surface, the roofing structure comprising:

a decking layer providing a structural support for the roofing structure;

a base layer disposed over the decking layer, the base layer including a plurality of strips including a first base layer strip adjacent to a second base layer strip so as to form a first base layer seam between the first base layer strip and the second base layer strip;

a cap layer disposed over the base layer, the cap layer including a plurality of strips including a first cap layer strip adjacent to a second cap layer strip so as to form a first cap layer seam between the first cap layer strip and the second cap layer strip, wherein the first cap layer seam is spaced from the first base layer seam along the surface of the roofing structure; and a plurality of rails disposed over the cap layer and spaced apart across the surface of the roofing structure, the plurality of rails including a first rail aligned with the first base layer seam and a second rail aligned with the first cap layer seam.

Embodiment 2. The roofing structure according to embodiment 1, further comprising a fire-resistant layer disposed between the decking layer and the base layer.

Embodiment 3. The roofing structure according to embodiment 2, wherein the fire-resistant layer comprises gypsum.

Embodiment 4. The roofing structure according to embodiment 2 or embodiment 3, wherein the fire-resistant layer is attached to the decking layer using mechanical fasteners.

Embodiment 5. The roofing structure according to any of embodiments 1 to 4, wherein the decking layer includes a wood board.

Embodiment 6. The roofing structure according to any of embodiments 1 to 5, wherein the base layer is formed of a bituminous membrane.

Embodiment 7. The roofing structure according to any of embodiments 1 to 6, wherein the base layer is formed of a rollable material.

Embodiment 8. The roofing structure according to any of embodiments 1 to 7, wherein the base layer includes mineral matter.

Embodiment 9. The roofing structure according to any of embodiments 1 to 8, wherein a bottom surface of each base layer strip is secured in the roofing structure by adhesion.

Embodiment 10. The roofing structure according to any of embodiments 1 to 9, wherein the cap layer is formed of a bituminous membrane.

Embodiment 11. The roofing structure according to any of embodiments 1 to 10, wherein the cap layer is formed of a rollable material.

Embodiment 12. The roofing structure according to any of embodiments 1 to 11, wherein a surface of the cap layer includes mineral matter.

Embodiment 13. The roofing structure according to any of embodiments 1 to 12, wherein a bottom surface of each cap layer strip is sealed around a perimeter of the cap layer strip with a sealant.

Embodiment 14. The roofing structure according to any of embodiments 1 to 13, wherein the first base layer seam is an overlapping seam including an overlapping portion of the second base layer strip disposed over an underlapping portion of the first base layer strip.

Embodiment 15. The roofing structure according to embodiment 14, wherein the overlap of the overlapping portion of the second base layer strip and the underlapping portion of the first base layer strip is at least 2 inches, e.g., at least 4 inches, e.g., about 6 inches.

Embodiment 16. The roofing structure according to embodiment 14 or embodiment 15, wherein the overlap of the overlapping portion of the second base layer strip and the underlapping portion of the first base layer strip is no more than 12 inches, e.g., no more than 10 inches, e.g., no more than 8 inches.

Embodiment 17. The roofing structure according to embodiment any of embodiments 14 to 16, wherein the overlapping portion of the second base layer strip is adhered to the underlapping portion of the first base layer strip.

Embodiment 18. The roofing structure according to any of embodiments 14 to 17, wherein the first rail is disposed over the overlapping portion of the second base layer strip.

Embodiment 19. The roofing structure according to any of embodiments 1 to 18, wherein the first rail is disposed at a side edge of the second base layer strip.

Embodiment 20. The roofing structure according to any of embodiments 1 to 19, wherein the first cap layer seam is an overlapping seam including an overlapping portion of the second cap layer strip disposed over an underlapping portion of the first cap layer strip.

Embodiment 21. The roofing structure according to embodiment 20, wherein the overlap of the overlapping portion of the second cap layer strip and the underlapping portion of the first cap layer strip is at least 1 inch, e.g., at least 2 inches, e.g., about 3 inches.

Embodiment 22. The roofing structure according to embodiment 20 or embodiment 21, wherein the overlap of the overlapping portion of the second cap layer strip and the underlapping portion of the first cap layer strip is no more than 8 inches, no more than 6 inches, e.g., no more than 4 inches.

Embodiment 23. The roofing structure according to any of embodiments 20 to 22, wherein sealant is disposed between the overlapping portion of the second cap layer strip and the underlapping portion of the first cap layer strip.

Embodiment 24. The roofing structure according to any of embodiments 20 to 23, wherein the second rail is disposed over the overlapping portion of the second cap layer strip.

Embodiment 25. The roofing structure according to any of embodiments 1 to 24, wherein the second rail is disposed at a side edge of the second cap layer strip.

Embodiment 26. The roofing structure according to any of embodiments 1 to 25, wherein the plurality of rails includes a third rail, wherein the third rail is spaced from the seams of the base layer and spaced from the seams of the cap layer.

Embodiment 27. The roofing structure according to any of embodiments 1 to 26, wherein each of the strips of the base layer and the cap layer extend in a first direction.

Embodiment 28. The roofing structure according to any of embodiments 1 to 27, wherein each of the rails extend in the first direction.

Embodiment 29. The roofing structure according to any of embodiments 1 to 28, wherein the rails are regularly spaced from one another across the roofing structure.

Embodiment 30. The roofing structure according to any of embodiments 1 to 29, wherein each of the rails includes a batten that is secured to the decking layer using a group of mechanical fasteners spaced along the length of the batten.

Embodiment 31. The roofing structure according to embodiment 30, wherein each of the rails includes a cap configured to cover the batten.

Embodiment 32. The roofing structure according to embodiment 31, wherein the cap of each rail has a triangular configuration.

Embodiment 33. The roofing structure according to embodiment 31 or embodiment 32, wherein the cap of each rail encloses an interior space and wherein the fastener heads of the respective group of mechanical fasteners is disposed within the interior space.

Embodiment 34. The roofing structure according to any of embodiments 1 to 33, wherein a lower end of the roofing structure includes an eave.

Embodiment 35. The roofing structure according to embodiment 34, wherein a flashing element is disposed at the lower end, and wherein a portion of the flashing element is disposed between the decking layer and the base sheet layer.

Embodiment 36. The roofing structure according to embodiment 34 or embodiment 35, wherein a shingle is disposed between the base layer and the cap layer at the lower end of the roofing structure.

Embodiment 37. The roofing structure according to any of embodiments 1 to 36, wherein an upper end of the roofing structure includes a two-piece flashing assembly, including an inner flashing element having a portion that extends under the cap sheet layer and an outer flashing element that extends over the inner flashing element.

Embodiment 38. The roofing structure according to any of embodiments 1 to 37, wherein a rake edge of the roofing structure includes a two-piece flashing assembly, including an inner flashing element having a portion that extends under the cap sheet layer and an outer flashing element that extends over the inner flashing element.

Embodiment 39. The roofing structure according to any of embodiments 1 to 38, wherein the roofing structure includes a first roofing panel and a second roofing panel adjacent to the first roofing panel so as to form a panel seam, and wherein the first base layer strip, the second base layer strip, the first cap layer strip, and the second cap layer strip are all part of the first roofing panel.

Embodiment 40. The roofing structure according to embodiment 39, wherein a lower end of the roofing structure includes a shingle that extends from the first roofing panel to the second roofing panel so as to overlap the panel seam, and wherein the shingle is disposed over the base layer and under the cap layer.

Embodiment 41. The roofing structure according to embodiment 39 or embodiment 40, further comprising a seam covering layer disposed over the base layer of the first roofing panel and the base layer of the second roofing panel so as to overlap the panel seam.

Embodiment 42. The roofing structure according to any of embodiments 39 to 41, wherein a lower end of the roofing structure includes a flashing element that extends from the first roofing panel to the second roofing panel so as to overlap the panel seam.

Embodiment 43. The roofing structure according to any of embodiments 39 to 42, wherein the cap layer includes a seam cap layer strip that covers the panel seam.

Embodiment 44. The roofing structure according to embodiment 43, wherein the seam cap layer strip is covered by no more than two of the rails.

Embodiment 45. The roofing structure according to any of embodiments 39 to 44, wherein each of the plurality of rails is aligned with a custom grid.

Embodiment 46. The roofing structure according to any of embodiments 1 to 45, wherein the roofing structure has a slope of at least 2/12, e.g., 3/12, e.g., 5/12, e.g., 7/12.

Embodiment 47. The roofing structure according to embodiment 46, wherein the roofing structure meets UL Class A fire resistance standards.

Embodiment 48. A roofing panel including the roofing structure according to any of embodiments 1 to 38, wherein the decking layer defines a first lateral edge of the roofing panel.

Embodiment 49. The roofing panel according to embodiment 48, wherein an edge of the cap layer is set back from the first lateral edge.

Embodiment 50. The roofing panel according to embodiment 48 or embodiment 49, wherein a width of the roofing panel is at least 3 feet, e.g., at least 4 feet, e.g., at least 6 feet.

Embodiment 51. The roofing panel according to any of embodiments 48 to 50, wherein a width of the roofing panel is no more than 20 feet, e.g., no more than 15 feet, e.g., no more than 10 feet.

Embodiment 52. The roofing panel according to any of embodiments 48 to 51, wherein a length of the roofing panel is at least 6 feet, e.g., at least 8 feet, e.g., at least 10 feet.

Embodiment 53. The roofing panel according to any of embodiments 48 to 52, wherein a length of the roofing panel is no more than 100 feet, e.g., no more than 80 feet, e.g., no more than 60 feet.

Embodiment 54. The roofing panel according to any of embodiments 48 to 53, wherein the roofing panel is configured for installation in a range of slopes from 2/12 to 7/12.

Embodiment 55. The roofing panel according to any of embodiments 48 to 54, wherein the roofing panel meets UL Class A fire resistance standards when installed at a slope of 2/12, when installed at a slope of 5/12, and when installed at a slope of 7/12.

Embodiment 56. A method of constructing a roofing system, the method comprising:

positioning a first roofing panel according to any of embodiments 48 to 55 on a roof frame;

positioning a second roofing panel on the roof frame adjacent to the first roofing panel so as to form a panel seam between the first roofing panel and the second roofing panel.

Embodiment 57. The method according to embodiment 56, further comprising securing a shingle over a base layer of the first panel and over a base layer of the second panel so as to overlap the panel seam at a lower end of the roofing system.

Embodiment 58. The method according to embodiment 56 or embodiment 57, further comprising covering the panel seam with a seam covering layer disposed over the base layer of the first roofing panel and a base layer of the second roofing panel.

Embodiment 59. The method according to any of embodiments 56 to 58, further comprising securing a seam cap layer strip over the base layer of the first roofing panel and over a base layer of the second roofing panel so as to cover the panel seam.

Embodiment 60. The method according to embodiment 59, wherein securing the seam cap layer strip includes forming a first overlap region between the seam cap layer strip and the first cap layer strip of the first roofing panel and a second overlap region between the seam cap layer strip and a cap layer strip of the second roofing panel.

Embodiment 61. The method according to any of embodiments 56 to 60, further comprising attaching a first installation rail over the cap layer of the first roofing panel.

Embodiment 62. The method according to embodiment 61, further comprising attaching a second installation rail over a cap layer of the second roofing panel.

Embodiment 63. The method according to embodiment 62, wherein the first installation rail is positioned at a predetermined distance from an existing rail of the first roofing panel, wherein the second installation rail is positioned at the predetermined distance from the first installation rail, and wherein an existing rail of the second roofing panel is positioned at the predetermined distance from the second installation rail.

Embodiment 64. The method according to any of embodiments 56 to 63, wherein the first roofing panel is positioned on the roofing frame at an installation location, and wherein the method further includes fabricating the first roofing panel at a first location and transporting the first roofing panel to the installation location.

What is claimed is:

1. A roofing structure that forms a roof surface, the roofing structure comprising:

a decking layer providing a structural support for the roofing structure;

a base layer disposed over the decking layer, the base layer including a plurality of strips including a first base layer strip adjacent to a second base layer strip so as to form a first base layer seam between the first base layer strip and the second base layer strip;

a cap layer disposed over the base layer, the cap layer including a plurality of strips including a first cap layer strip adjacent to a second cap layer strip so as to form a first cap layer seam between the first cap layer strip and the second cap layer strip, wherein the first cap layer seam is spaced from the first base layer seam along the surface of the roofing structure; and a plurality of rails disposed over the cap layer and spaced apart across the surface of the roofing structure, the plurality of rails including a first rail aligned with the first base layer seam and a second rail aligned with the first cap layer seam.

2. The roofing structure according to claim 1, further comprising a fire-resistant layer disposed between the decking layer and the base layer.

3. The roofing structure according to claim 2, wherein the fire-resistant layer comprises gypsum.

4. The roofing structure according to claim 1, wherein at least one of the base layer and the cap layer is formed of a bituminous membrane.

5. The roofing structure according to claim 1, wherein at least one of the base layer and the cap layer is formed of a rollable material.

6. The roofing structure according to claim 1, wherein the first base layer seam is an overlapping seam including an overlapping portion of the second base layer strip disposed over an underlapping portion of the first base layer strip.

7. The roofing structure according to claim 6, wherein the first rail is disposed over the overlapping portion of the second base layer strip.

8. The roofing structure according to claim 1, wherein the first rail is disposed at a side edge of the second base layer strip.

9. The roofing structure according to claim 1, wherein the first cap layer seam is an overlapping seam including an overlapping portion of the second cap layer strip disposed over an underlapping portion of the first cap layer strip.

10. The roofing structure according to claim 9, wherein the second rail is disposed over the overlapping portion of the second cap layer strip.

11. The roofing structure according to claim 1, wherein the second rail is disposed at a side edge of the second cap layer strip.

12. The roofing structure according to claim 1, wherein the plurality of rails includes a third rail, wherein the third rail is spaced from the seams of the base layer and spaced from the seams of the cap layer.

13. The roofing structure according to claim 1, wherein each of the rails includes a batten that is secured to the decking layer using a group of mechanical fasteners spaced along the length of the batten.

14. The roofing structure according to claim 13, wherein each of the rails includes a cap configured to cover the batten.

15. A roofing panel including the roofing structure according to claim 1, wherein the decking layer defines a first lateral edge of the roofing panel.

16. The roofing panel according to claim 15, wherein an edge of the cap layer is set back from the first lateral edge.

17. A method of constructing a roofing system, the method comprising:

positioning a first roofing panel on a roof frame, the first roofing panel including a roofing structure comprising:

a decking layer providing a structural support for the roofing structure, a base layer disposed over the decking layer, the base layer including a plurality of strips including a first base layer strip adjacent to a second base layer strip so as to form a first base layer seam between the first base layer strip and the second base layer strip, a cap layer disposed over the base layer, the cap layer including a plurality of strips including a first cap layer strip adjacent to a second cap layer strip so as to form a first cap layer seam between the first cap layer strip and the second cap layer strip, wherein the first cap layer seam is spaced from the first base layer seam along the surface of the roofing structure, and a plurality of rails disposed over the cap layer and spaced apart across the surface of the roofing structure, the plurality of rails including a first rail aligned with the first base layer seam and a second rail aligned with the first cap layer seam; and positioning a second roofing panel on the roof frame adjacent to the first roofing panel so as to form a panel seam between the first roofing panel and the second roofing panel.

18. The method according to claim 17, further comprising covering the panel seam with a seam covering layer disposed over the base layer of the first roofing panel and a base layer of the second roofing panel.

19. The method according to claim 17, further comprising attaching a first installation rail over the cap layer of the first roofing panel.

20. The method according to claim 17, wherein the first roofing panel is positioned on the roofing frame at an installation location, and wherein the method further includes fabricating the first roofing panel at a first location and transporting the first roofing panel to the installation location.

* * * * *